US009389013B2

(12) United States Patent
Rolek et al.

(10) Patent No.: US 9,389,013 B2
(45) Date of Patent: Jul. 12, 2016

(54) THERMAL FRAME FOR A REFRIGERATED ENCLOSURE

(71) Applicant: Anthony International, Sylmar, CA (US)

(72) Inventors: Matthew Rolek, Valencia, CA (US); Jeffery W. Nicholson, Palmdale, CA (US); Paul J. Artwohl, Stevensville, MI (US); Matthew Walp, Valencia, CA (US)

(73) Assignee: Anthony International, Sylmar, CA (US)

( * ) Notice: Subject to any disclaimer, the term of this patent is extended or adjusted under 35 U.S.C. 154(b) by 1 day.

(21) Appl. No.: 14/460,973

(22) Filed: Aug. 15, 2014

(65) Prior Publication Data

US 2016/0047592 A1 Feb. 18, 2016

(51) Int. Cl.

| | |
|---|---|
| ***F25D 23/06*** | (2006.01) |
| ***A47F 3/04*** | (2006.01) |
| ***E06B 1/04*** | (2006.01) |

(52) U.S. Cl.

CPC ..... *F25D 23/065* (2013.01); *A47F 3/0426* (2013.01); *E06B 1/04* (2013.01); *F25D 23/063* (2013.01); *F25D 23/069* (2013.01); *F25D 2201/10* (2013.01); *F25D 2201/14* (2013.01)

(58) Field of Classification Search

CPC ..... F25D 23/028; F25D 23/02; F25D 23/06; F25D 23/062; F25D 23/065; F25D 23/068; F25D 2201/14; F25D 2323/06; E06B 1/12; E06B 1/14; E06B 1/16; E06B 1/18; E06B 1/26; E06B 1/28; E06B 1/30; E06B 1/32; E06B 1/325; E06B 1/52; E06B 1/524; A47F 3/04; A47F 3/0404; A47F 3/0426; A47F 3/043; A47F 3/0434

USPC ..... 49/504

See application file for complete search history.

(56) References Cited

U.S. PATENT DOCUMENTS

| | | | | |
|---|---|---|---|---|
| 4,831,780 A | | 5/1989 | Bockwinkel | |
| 4,941,289 A | * | 7/1990 | Rolek | 49/504 |
| 5,111,618 A | * | 5/1992 | Kaspar et al. | 49/501 |

(Continued)

FOREIGN PATENT DOCUMENTS

| | | | | |
|---|---|---|---|---|
| DE | 102011087036 A1 | * | 5/2013 | F25D 23/06 |
| EP | 2 829 827 | | 1/2015 | |

(Continued)

OTHER PUBLICATIONS

Extended European Search Report for EP Application No. 15172707, dated Jan. 7, 2016, 7 pages.

*Primary Examiner* — Andrew Roersma
(74) *Attorney, Agent, or Firm* — Foley & Lardner LLP

(57) ABSTRACT

A thermal frame for an opening in a refrigerated enclosure includes a perimeter frame segment fixed to the refrigerated enclosure along a perimeter of the opening. The thermal frame includes a first vacuum panel fixed relative to the perimeter frame segment and configured to reduce heat transfer through the perimeter frame segment. The thermal frame may include a mullion frame segment fixed to the refrigerated enclosure and dividing the opening into a plurality of smaller openings. The thermal frame may include a second vacuum panel fixed relative to the mullion frame segment and configured to reduce heat transfer through the mullion frame segment.

20 Claims, 11 Drawing Sheets

(56) References Cited

U.S. PATENT DOCUMENTS

| | | | | |
|---|---|---|---|---|
| 5,175,975 | A * | 1/1993 | Benson et al. | 52/788.1 |
| 5,522,216 | A * | 6/1996 | Park et al. | 62/3.6 |
| 5,843,353 | A * | 12/1998 | De Vos et al. | 264/102 |
| 6,298,615 | B1 | 10/2001 | Richardson | |
| 6,367,223 | B1 | 4/2002 | Richardson et al. | |
| 6,606,832 | B2 | 8/2003 | Richardson et al. | |
| 6,606,833 | B2 | 8/2003 | Richardson et al. | |
| 6,868,688 | B2 * | 3/2005 | Narehood | 62/275 |
| 6,938,968 | B2 * | 9/2005 | Tanimoto et al. | 312/406 |
| 7,156,478 | B2 * | 1/2007 | Harn et al. | 312/334.6 |
| 8,393,130 | B2 | 3/2013 | Stubblefield | |
| 2012/0297813 | A1 * | 11/2012 | Hanley et al. | 62/331 |
| 2013/0285517 | A1 * | 10/2013 | Wach et al. | 312/114 |
| 2015/0250332 | A1 * | 9/2015 | Mille et al. | A47F 3/0408 |

FOREIGN PATENT DOCUMENTS

| | | | | |
|---|---|---|---|---|
| WO | WO-2013/140658 | | 9/2013 | |
| WO | WO2014020394 | A1 * | 2/2014 | F25D 23/06 |
| WO | WO2014044330 | A1 * | 3/2014 | A47F 3/04 |

* cited by examiner

THERMAL FRAME FOR A REFRIGERATED ENCLOSURE

BACKGROUND

The present invention relates generally to the field of refrigerated enclosures (e.g., refrigerators, freezers, refrigerated merchandisers, etc.) for storing and/or displaying refrigerated or frozen objects. The present invention relates more particularly to a thermal frame for a refrigerated enclosure. The present invention relates more particularly still to a thermal frame that includes a vacuum panel for improved thermal insulation.

Refrigerated enclosures are used in commercial, institutional, and residential applications for storing and/or displaying refrigerated or frozen objects. The term "refrigerated" is used herein to refer both to refrigerators at temperatures above freezing and to freezers at temperatures below freezing. Refrigerated enclosures typically have one or more user-operable doors or windows for accessing refrigerated or frozen objects within a temperature-controlled space.

One type of refrigerated enclosure is a refrigerated display case. Refrigerated display cases are used to display products that must be stored at relatively low temperatures and often include shelves, glass doors and/or glass walls to permit viewing of the products supported by the shelves. For example, grocery stores, supermarkets, convenience stores, florist shops, and other commercial settings often use self-service type refrigerated display cases or merchandisers to store and display temperature-sensitive consumer goods (e.g., food products and the like).

Another type of refrigerated enclosure is a refrigerated storage unit. Refrigerated storage units are commonly found in warehouses, restaurants and lounges. Refrigerated storage units may also include shelves and are used to store food, beverages and other items stored at relatively low temperatures. Refrigerated display cases and storage units may be free standing units or "built in" units that form an actual part of the building in which they are located.

Whether free standing or built in, refrigerated enclosures typically include a frame that supports one or more doors or windows. The frame may define a forward portion of the surrounding enclosure and may include top, bottom, and side members. In instances where the frame supports more than one door, the frame may also include one or more vertically extending mullions. Traditional frames are made of a structurally reliable material such as aluminum, steel, or other metals; however, such materials are often poor thermal insulators. Other frames are made of plastics or filled with an insulating foam; however, such materials often lack structural integrity and reliability. Accordingly, it would be desirable to provide a frame for a refrigerated enclosure that overcomes these and/or other disadvantages.

SUMMARY

One implementation of the present disclosure is a thermal frame for an opening in a refrigerated enclosure. The thermal frame includes a perimeter frame segment fixed to the refrigerated enclosure along a perimeter of the opening. The perimeter frame segment includes a first wall extending rearwardly from a frontal portion of the refrigerated enclosure, a second wall extending in a second direction from a rearward edge of the first wall, and a third wall extending from the second wall toward the frontal portion of the refrigerated enclosure to define a first channel between the first, second, and third walls. The thermal frame further includes a vacuum panel fixed relative to the perimeter frame segment. The vacuum panel includes a first surface disposed rearward of the second wall, a second surface disposed rearward of the first surface and offset from the first surface by a thickness, and an evacuated chamber between the first and second surfaces.

The vacuum panel may be configured to reduce heat transfer through the perimeter frame segment. In some embodiments, the vacuum panel has a thermal resistance between $$25\ \frac{\text{hr}\cdot\text{ft}^2\cdot{}^\circ\text{ F.}}{\text{BTU}}$$

per inch of the thickness and $$100\ \frac{\text{hr}\cdot\text{ft}^2\cdot{}^\circ\text{ F.}}{\text{BTU}}$$

per inch of the thickness.

In some embodiments, the vacuum panel includes at least one bend and the evacuated chamber is a continuous chamber bridging the bend. For example, the vacuum panel may include a third surface extending from the first surface toward the frontal portion of the refrigerated enclosure, and a fourth surface extending from the second surface toward the frontal portion of the refrigerated enclosure and offset from the third surface by the thickness in the second direction. The evacuated chamber may extend between the third and fourth surfaces.

In some embodiments, the thermal frame includes a mounting bracket configured to secure the perimeter frame segment to the perimeter of the opening and to support the vacuum panel. The perimeter frame segment may include a flange projecting from the third wall and the mounting bracket may be coupled to the perimeter frame segment via the flange.

In some embodiments, the mounting bracket includes a fourth wall disposed between the first wall of the perimeter frame segment and the perimeter of the opening, a fifth wall disposed between the second wall of the perimeter frame segment and the first surface of the vacuum panel and extending in the second direction from a rearward edge of the fourth wall, and a sixth wall extending from the fifth wall toward the frontal portion of the refrigerated enclosure to define a second channel between the fourth, fifth, and sixth walls. The perimeter frame segment may be located at least partially within the second channel.

In some embodiments, the mounting bracket includes a fifth wall disposed between the second wall of the perimeter frame segment and the first surface of the vacuum panel, a seventh wall coupled to a first end of the fifth wall and extending rearward of the fifth wall, and an eighth wall coupled to a second end of the fifth wall, opposite the first end, and extending rearward of the fifth wall. The fifth, seventh, and eighth walls may at least partially define a third channel within which the vacuum panel is contained.

In some embodiments, the eighth wall is offset from the sixth wall in the second direction and the mounting bracket further includes a sixth wall extending from the second end of the fifth wall toward the frontal portion of the refrigerated enclosure and a ninth wall extending between the sixth wall and the eighth wall to define a portion of the third channel between the sixth, eighth, and ninth walls.

In some embodiments, the thermal frame further includes a cover extending between the seventh and eighth walls and closing the third channel. The cover may include a first engagement feature located along a first edge of the cover and configured to engage a corresponding engagement feature of the seventh wall and a second engagement feature located along a second edge of the cover and configured to engage a corresponding engagement feature of the eighth wall.

In some embodiments, the thermal frame further includes a contact plate extending between the first and third walls and closing the first channel. The thermal frame may further include a retaining clip coupled to the third wall of the perimeter frame segment and configured to hold the contact plate in position between the first and third walls.

Another implementation of the present disclosure is thermal frame for an opening in a refrigerated enclosure. The thermal frame includes a mullion frame segment fixed to the refrigerated enclosure and dividing the opening into a plurality of smaller openings. The mullion frame segment includes a first wall extending rearwardly relative to a frontal portion of the refrigerated enclosure, a second wall extending in a second direction from a rearward edge of the first wall, and a third wall extending from the second wall toward the frontal portion of the refrigerated enclosure to define a first channel between the first, second, and third walls. The thermal frame further includes a vacuum panel fixed relative to the mullion frame segment. The vacuum panel includes a first surface disposed rearward of the second wall, a second surface disposed rearward of the first surface and offset from the first surface by a thickness, and an evacuated chamber between the first and second surfaces.

The vacuum panel may be configured to reduce heat transfer through the mullion frame segment. In some embodiments, the vacuum panel has a thermal resistance between $$25\ \frac{\text{hr}\cdot\text{ft}^2\cdot{}^\circ\text{ F.}}{\text{BTU}}$$

per inch of the thickness and $$100\ \frac{\text{hr}\cdot\text{ft}^2\cdot{}^\circ\text{ F.}}{\text{BTU}}$$

per inch of the thickness.

In some embodiments, the vacuum panel includes at least one bend and the evacuated chamber is a continuous chamber bridging the bend. For example, the vacuum panel may include a third surface extending from a first edge of the first surface toward the frontal portion of the refrigerated enclosure and a fourth surface extending from a first edge of the second surface toward the frontal portion of the refrigerated enclosure and offset from the third surface by the thickness in the second direction. The evacuated chamber may extend between the third and fourth surfaces. In some embodiments, the vacuum panel includes a fifth surface extending from a second edge of the first surface and toward the frontal portion of the refrigerated enclosure and a sixth surface extending from a second edge of the second surface toward the frontal portion of the refrigerated enclosure and offset from the fifth surface by the thickness in a third direction opposite the second direction. The evacuated chamber may extend between the fifth and sixth surfaces.

In some embodiments, the mullion frame segment includes an inverted fillet connecting the second wall with at least one of the first wall and the third wall. The inverted fillet may include a convex surface along an interior of the first channel and a concave surface along an exterior of the first channel.

In some embodiments, the thermal frame includes a mounting bracket configured to secure the vacuum panel to the mullion frame segment. The mullion frame segment may include a flange projecting from at least one of the first wall and the third wall, and the mounting bracket may be coupled to the mullion frame segment via the flange.

In some embodiments, the mounting bracket includes a fourth wall extending rearwardly along an exterior surface of the first wall, a fifth wall disposed between the second wall of the mullion frame segment and the first surface of the vacuum panel and extending in the second direction from a rearward edge of the fourth wall, and a sixth wall extending from the fifth wall toward the frontal portion of the refrigerated enclosure to define a second channel between the fourth, fifth, and sixth walls. The mullion frame segment may be located at least partially within the second channel.

In some embodiments, the mounting bracket includes a fifth wall disposed between the second wall of the mullion frame segment and the first surface of the vacuum panel, a seventh wall coupled to a first end of the fifth wall and extending rearward of the fifth wall, and an eighth wall coupled to a second end of the fifth wall, opposite the first end, and extending rearward of the fifth wall. The fifth, seventh, and eighth walls may at least partially define a third channel within which the vacuum panel is contained.

In some embodiments, the seventh wall is offset from the first wall in a third direction opposite the second direction and the mounting bracket further includes a fourth wall extending from the first end of the fifth wall toward the frontal portion of the refrigerated enclosure and a ninth wall extending between the fourth wall and the seventh wall to define a portion of the third channel between the fourth, seventh, and ninth walls.

In some embodiments, the eighth wall is offset from the third wall in the second direction and the mounting bracket further includes a sixth wall extending from the second end of the fifth wall toward the frontal portion of the refrigerated enclosure and a tenth wall extending between the sixth wall and the eighth wall to define a portion of the third channel between the sixth, eighth, and tenth walls.

In some embodiments, the thermal frame includes a cover extending between the seventh and eighth walls and closing the third channel. The cover may include a first engagement feature located along a first edge of the cover and configured to engage a corresponding engagement feature of the seventh wall and a second engagement feature located along a second edge of the cover and configured to engage a corresponding engagement feature of the eighth wall.

Another implementation of the present disclosure is a thermal frame for an opening in a refrigerated enclosure. The thermal frame includes a perimeter frame segment fixed to the refrigerated enclosure along a perimeter of the opening, a mullion frame segment fixed to the refrigerated enclosure and dividing the opening into a plurality of smaller openings, a first vacuum panel fixed relative to the perimeter frame segment and configured to reduce heat transfer through the perimeter frame segment, and a second vacuum panel fixed relative to the mullion frame segment and configured to reduce heat transfer through the mullion frame segment.

In some embodiments, at least one of the first vacuum panel and the second vacuum panel includes a plurality of interconnected sub-panels oriented in multiple different directions, a bend disposed at an edge between the plurality of sub-panels, and an evacuated chamber bridging the bend and extending continuously within the plurality of sub-panels.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
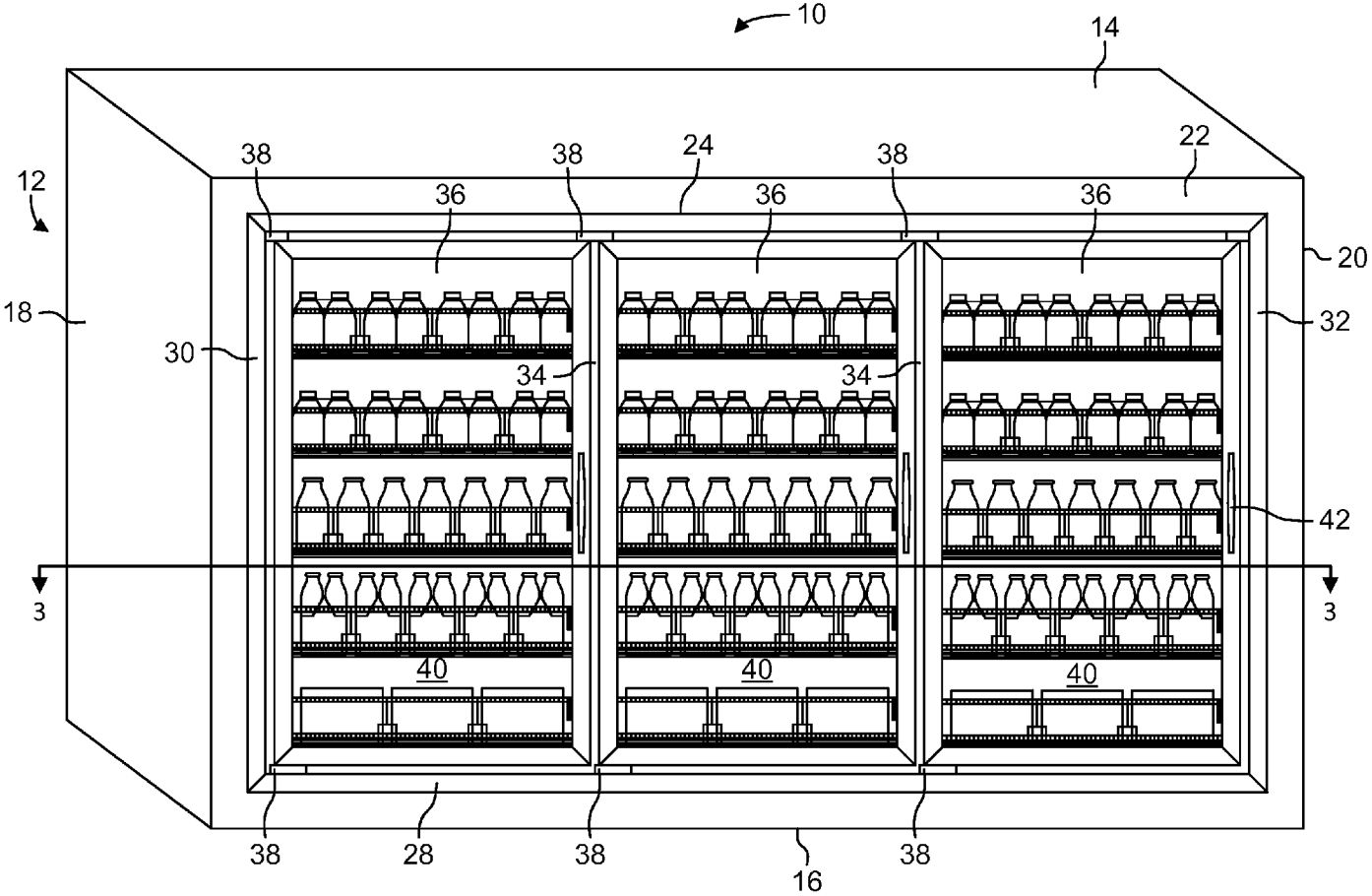
FIG. 1 is a perspective view of a refrigerated enclosure having multiple doors supported by a thermal frame, according to an exemplary embodiment.

Referring generally to the FIGURES, a thermal frame for a refrigerated enclosure and components thereof are shown, according to various exemplary embodiments. The term "refrigerated" is used herein to refer both to refrigerators at temperatures above freezing and to freezers at temperatures below freezing. The thermal frame described herein may part of a refrigerated enclosure (e.g., a refrigerated display case, a refrigerated merchandiser, a refrigerated storage case, etc.) used in a commercial, institutional, residential, or other setting for storing and/or displaying refrigerated or frozen objects.

The refrigerated enclosure may include a body (e.g., a top wall, a bottom wall, a plurality of side walls, etc.) defining a temperature-controlled space. The thermal frame may include a plurality of frame segments located within the opening and may be configured to support a door or window for accessing items within the temperature-controlled space. The plurality of frame segments may include, for example, perimeter frame segments forming a closed shape along a perimeter of the opening and mullion frame segments dividing the opening into multiple smaller openings. Advantageously, one or more of the frame segments may include a vacuum panel attached thereto. In some embodiments, the vacuum panel is not part of the door, but rather fixed to a segment of the frame to reduce heat transfer through the frame.

The vacuum panel may be attached to a rear surface of a frame segment to provide a layer of thermal insulation between the frame and the temperature-controlled space. The vacuum panel may include a first surface, a second surface offset from the first surface by a thickness, and an evacuated chamber between the first and second surfaces. In some embodiments, the vacuum panel has a thermal resistance between $$25\ \frac{\text{hr}\cdot\text{ft}^2\cdot{}^\circ\text{ F.}}{\text{BTU}}$$

and $$100\ \frac{\text{hr}\cdot\text{ft}^2\cdot{}^\circ\text{ F.}}{\text{BTU}}$$

per inch of the thickness. The vacuum panel may be bendable and may be contoured around corners of the frame segments. For example, the vacuum panel may be bent into an "L" shape or a "U" shape to allow the vacuum panel to cover adjacent surfaces of the frame segments that are oriented in multiple different directions (e.g., a rear surface, one or more side surfaces, etc.). The evacuated chamber may extend continuously through the bend such that the same evacuated chamber extends along multiple adjacent surfaces of the frame segments.

In some embodiments, the thermal frame includes mounting brackets attached to one or more of the frame segments. The mounting brackets may attach to the frame segments via interlocking grooves, flanges, recesses, lips, or other engagement features. In some embodiments, each mounting bracket defines a channel within which a corresponding frame segment is secured. The mounting brackets may be configured to couple the perimeter frame segments to the refrigerated enclosure and may be configured to secure the vacuum panels to the frame segments. In some embodiments, the mounting brackets define channels within which the vacuum panels are contained. The thermal frame may include covers configured to attach to the mounting brackets and to close the channels containing the vacuum panels.

Figure 2:
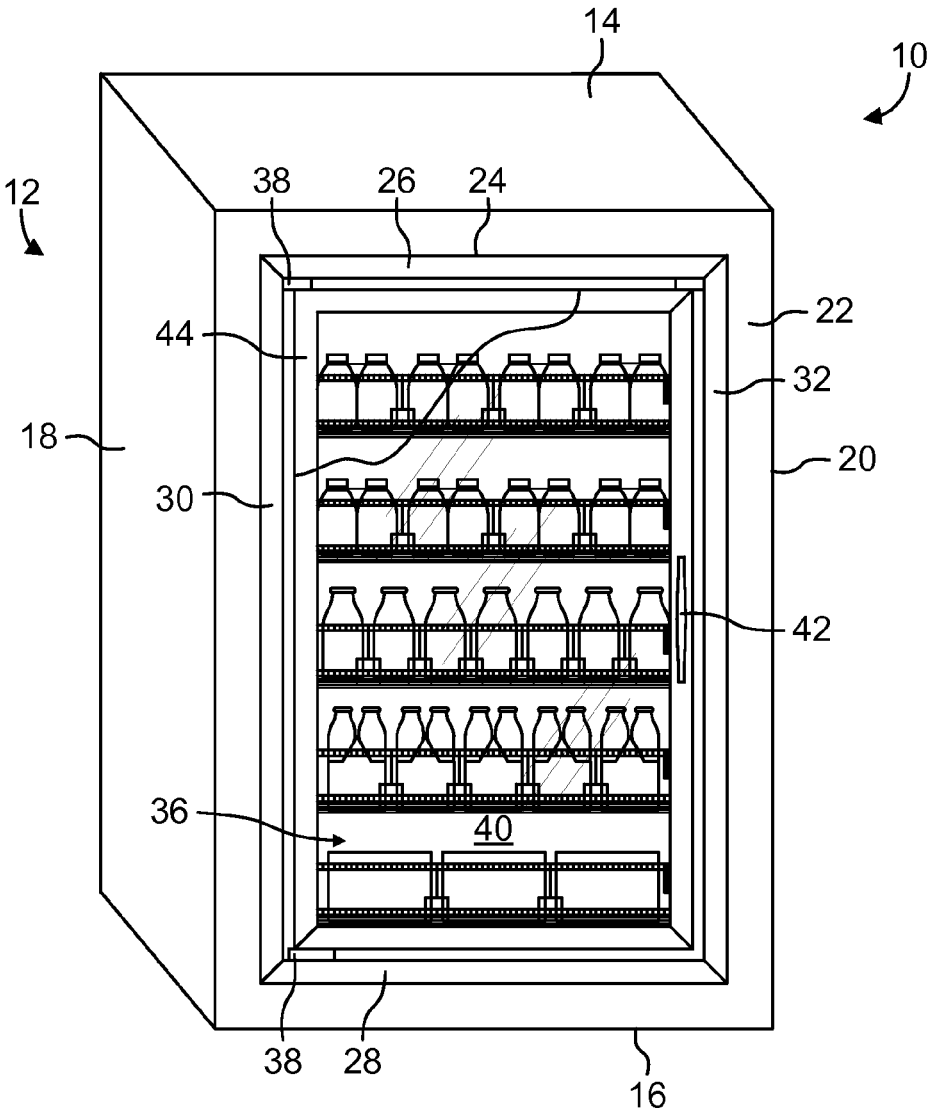
FIG. 2 is a perspective view of a refrigerated enclosure having a single door supported by a thermal frame, according to an exemplary embodiment.

Referring now to FIGS. 1-2, a refrigerated enclosure 10 is shown, according to an exemplary embodiment. Refrigerated enclosure 10 may be a refrigerator, freezer, or other enclosure defining a temperature-controlled space. In some embodiments, refrigerated enclosure is a refrigerated display case. Refrigerated enclosure 10 may be implemented, for example, as a refrigerated display case or refrigerated merchandiser in grocery stores, supermarkets, convenience stores, florist shops, and/or other commercial settings to store and display temperature-sensitive consumer goods (e.g., food products and the like). Refrigerated enclosure 10 may be used to display products that must be stored at relatively low temperatures and may include shelves, glass doors, and/or glass walls to permit viewing of the products supported by the shelves. In other embodiments, refrigerated enclosure 10 is a refrigerated storage unit and may be implemented, for example, in warehouses, restaurants, and lounges. Refrigerated enclosure 10 may be a free standing unit or "built in" unit that forms a part of the building in which refrigerated enclosure 10 is located.

Refrigerated enclosure 10 is shown to include a body portion 12. Body portion 12 may include a top wall 14, a bottom wall 16, a left side wall 18, a right size wall 20, a rear wall (not shown), and a frontal portion 22 defining a temperature-controlled space. Frontal portion 22 may include an opening into the temperature-controlled space. Thermal frame 24 may be situated at least partially within the opening. Thermal frame 24 is shown to include a plurality of perimeter frame segments (i.e., top frame segment 26, bottom frame segment 28, left side frame segment 30, right side frame segment 32) forming a closed shape along a perimeter of the opening. In some embodiments, thermal frame 24 includes one or more mullion frame segments 34 dividing the opening into multiple smaller openings. For example, FIG. 1 illustrates a three-door assembly with a pair of mullion frame segments 34 extending between top frame segment 26 and bottom frame segment 28 to divide the opening into three smaller openings. Each of the smaller openings may correspond to a separate door 36 of the three-door assembly. In other embodiments, mullion frame segments 34 may be omitted. For example, FIG. 2 illustrates a one-door assembly wherein thermal frame 24 includes perimeter frame segments 26-32 but not mullion frame segments 34.

Still referring to FIGS. 1-2, refrigerated enclosure 10 may include one or more doors 36 pivotally mounted on thermal frame 24 by hinges 38. In other embodiments, doors 36 may be sliding doors configured to open via linear motion. Doors 36 are shown to include panel assemblies 40 and handles 42. Referring particularly to FIG. 2, thermal frame 24 is shown to include a series of contact plates 44. Contact plates 44 may be attached to a frontal surface of thermal frame 24 and may be configured to provide a sealing surface against which doors 36 rest in the closed position. For example, doors 36 may include a gasket or other sealing feature around a perimeter of each door 36. In some embodiments, the gaskets employ a flexible bellows and magnet arrangement. When doors 36 are closed, the gaskets may engage contact plates 44 to provide a seal between doors 36 and thermal frame 24.

Figure 3:
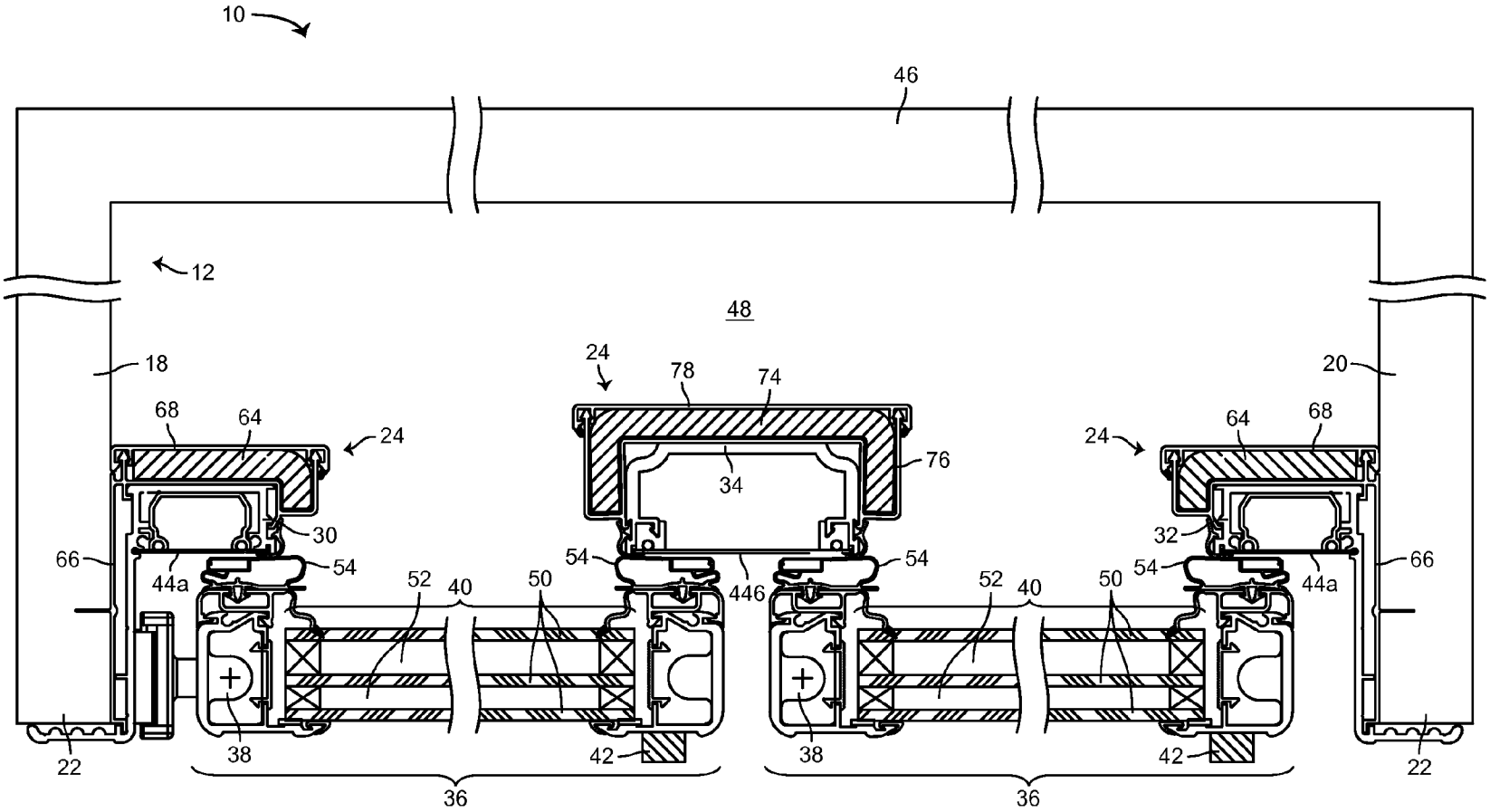
FIG. 3 is a cross-sectional view of the thermal frame of FIG. 1 illustrating a plurality of perimeter frame assemblies and a mullion frame assembly, according to an exemplary embodiment.

Referring now to FIG. 3, a cross-sectional plan view of refrigerated enclosure 10 taken along the line 3-3 in FIG. 1 is shown, according to an exemplary embodiment. Refrigerated enclosure 10 is shown to include a body portion 12 having a frontal portion 22, a pair of side walls 18 and 20 extending rearwardly from frontal portion 22, and a rear wall 46 extending between side walls 18 and 20 to define a temperature-controlled space 48 within body portion 12.

In FIG. 3, refrigerated enclosure 10 is shown as a two-door assembly with a pair of doors 36 positioned in an opening in frontal portion 22. In various embodiments, refrigerated enclosure 10 may have two doors 36 (as shown in FIG. 3), a lesser number of doors 36 (i.e., a single door as shown in FIG. 2), or a greater number of doors 36 (i.e., three or more doors as shown in FIG. 1). Each door 36 may include a panel assembly 40 and a handle 42. Applying a force to handle 42 may cause the corresponding door 36 to rotate about hinges 38 between an open position and a closed position. In some embodiments, panel assembly 40 is a transparent panel assembly through which items within temperature-controlled space 48 can be viewed when doors 36 are in the closed position. For example, panel assembly 40 is shown to include a plurality of transparent panels 50 with spaces 52 therebetween. Spaces 52 may be sealed and filled with an insulating gas (e.g., argon) or evacuated to produce a vacuum between panels 50. In other embodiments, panel assembly 40 may include opaque panels with an insulating foam or other insulator therebetween. Doors 36 are shown to include gaskets 54 attached to a rear surface of doors 36 along an outer perimeter of each door. Gaskets 54 may be configured to engage contact plates 44*a* and 44*b* (referred to collectively as contact plates 44) when doors 36 are in the closed position to provide a seal between doors 36 and contact plates 44.

Still referring to FIG. 3, thermal frame 24 is illustrated in greater detail, according to an exemplary embodiment. Each perimeter frame segment 30-32 may be coupled to body portion 12 via a mounting bracket 66. Mounting brackets 66 may be secured to perimeter frame segments 30-32 using one or more connection features (e.g., flanges, notches, grooves, collars, lips, etc.) or fasteners (e.g., bolts, screws, clips, etc.) and may hold perimeter frame segments 30-32 in a fixed position relative to body portion 12.

In some embodiments, mounting brackets 66 include a plurality of interconnected walls that define a front channel configured to receive perimeter frame segments 30-32 and a rear channel configured to receive vacuum panels 64. The rear channel may include at least one bend such that the rear channel extends along a rear surface of perimeter frame segments 30-32 and a side surface of perimeter frame segments 30-32. Vacuum panels 64 may be positioned within the rear channels to provide a layer of thermal insulation along the rear surface and/or side surface of perimeter frame segments 30-32. Covers 68 may be attached to mounting brackets 66 to close the rear channels and contain vacuum panels 64 therein.

Although only two perimeter frame segments 30-32 are shown in FIG. 3, other perimeter frame segments (e.g., top frame segment 26, bottom frame segment 28, etc.) may be configured in a similar manner. For example, top frame segment 26 and bottom frame segment 28 may be coupled to body portion 12 via mounting brackets 66. Mounting brackets 66 may be configured to receive and secure vacuum panels 64 along a rear surface of frame segments 26-28 and/or a side surface of frame segments 26-28. A perimeter frame segment assembly including a perimeter frame segment (i.e., one of frame segments 26-32), mounting bracket 66, vacuum panel 64, and cover 68 is described in greater detail with reference to FIGS. 4-8.

Mullion frame segment 34 may extend vertically between top frame segment 26 and bottom frame segment 28. In some embodiments, a top portion of mullion frame segment 34 is fastened to top frame segment 26 and a bottom portion of mullion frame segment 34 is fastened to bottom frame segment 28. Mounting bracket 76 may be secured to mullion frame segment 34 via one or more connection features (e.g., flanges, notches, grooves, collars, lips, etc.) or fasteners (e.g., bolts, screws, clips, etc.) that hold mounting bracket 76 in a fixed position relative to mullion frame segment 34.

In some embodiments, mounting bracket 76 includes a plurality of interconnected walls that define a front channel configured to receive mullion frame segment 34 and a rear channel configured to receive vacuum panel 74. The rear channel may include at least one bend such that the rear channel extends along a rear surface of mullion frame segment 34 and one or more side surfaces of mullion frame segment 34. Vacuum panel 74 may be positioned within the rear channel to provide a layer of thermal insulation along the rear surface and/or side surface of mullion frame segment 34. Cover 78 may be attached to mounting bracket 76 to close the rear channel and contain vacuum panel 74 therein. A mullion frame segment assembly including mullion frame segment 34, mounting bracket 76, vacuum panel 74, and cover 78 is described in greater detail with reference to FIGS. 9-13.

Figure 4:
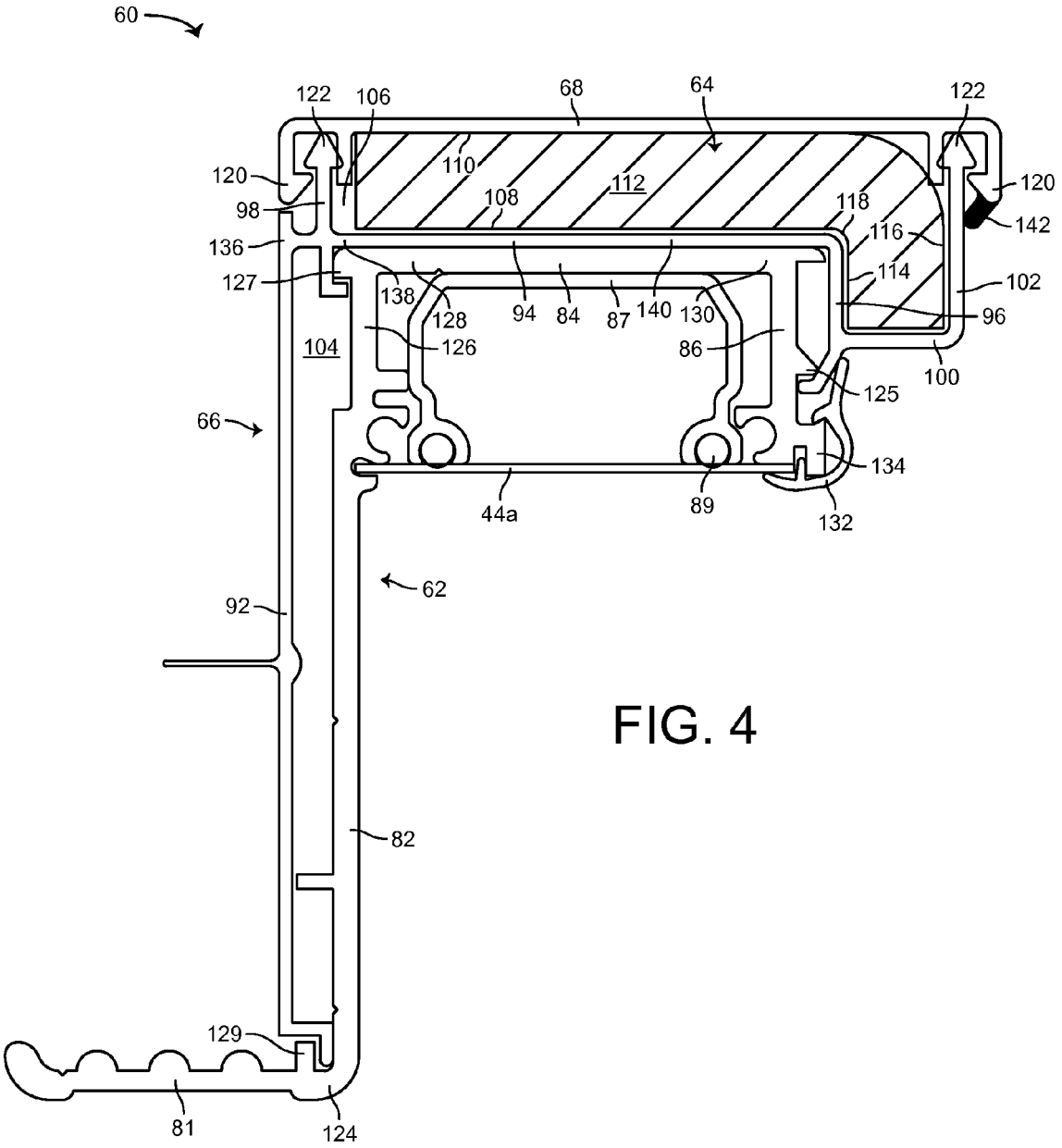
FIG. 4 is a cross-sectional view illustrating the perimeter frame assembly of FIG. 3 in greater detail and showing a perimeter frame segment, a mounting bracket, a vacuum panel, and a cover, according to an exemplary embodiment.
Figure 5:
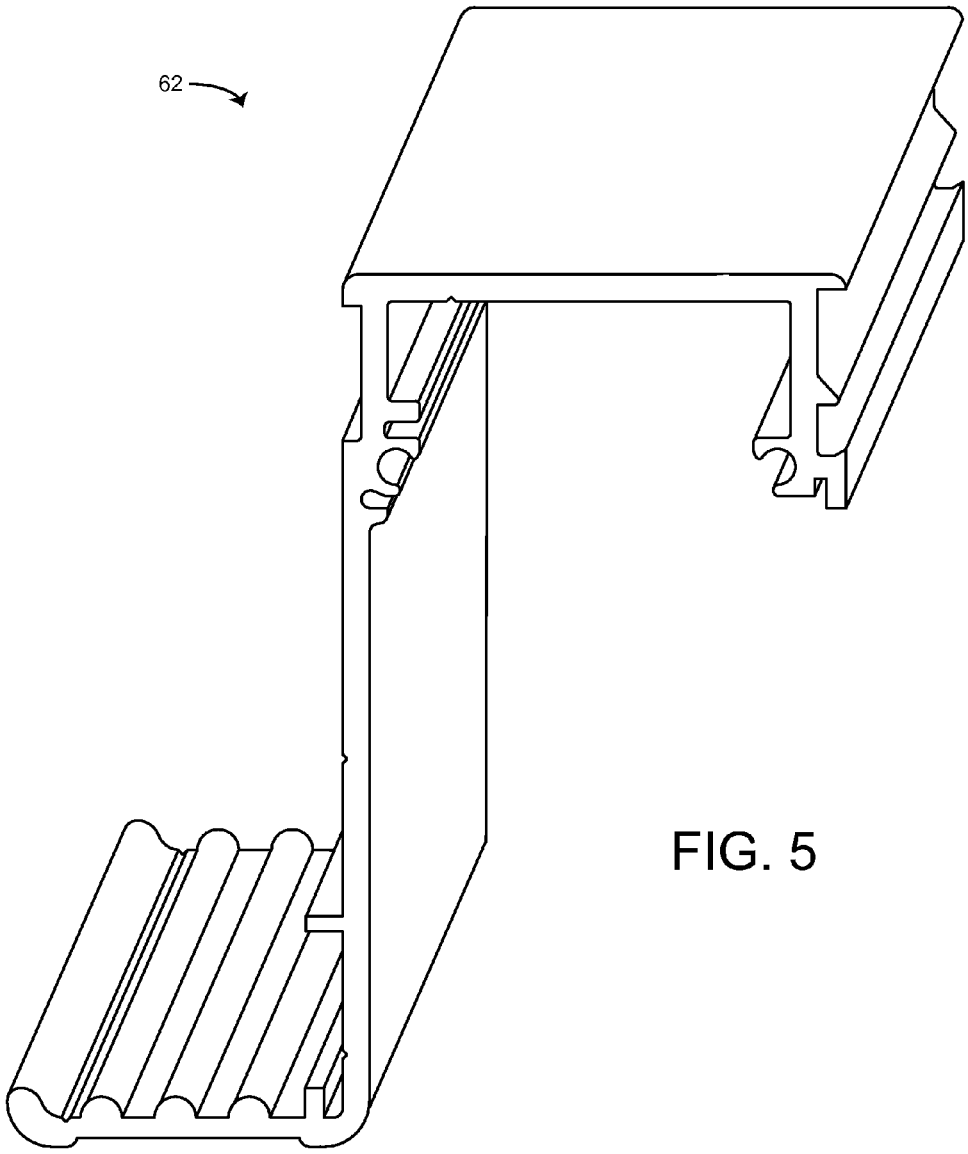
FIG. 5 is a perspective view illustrating the perimeter frame segment of FIG. 4 in greater detail, according to an exemplary embodiment.
Figure 6:
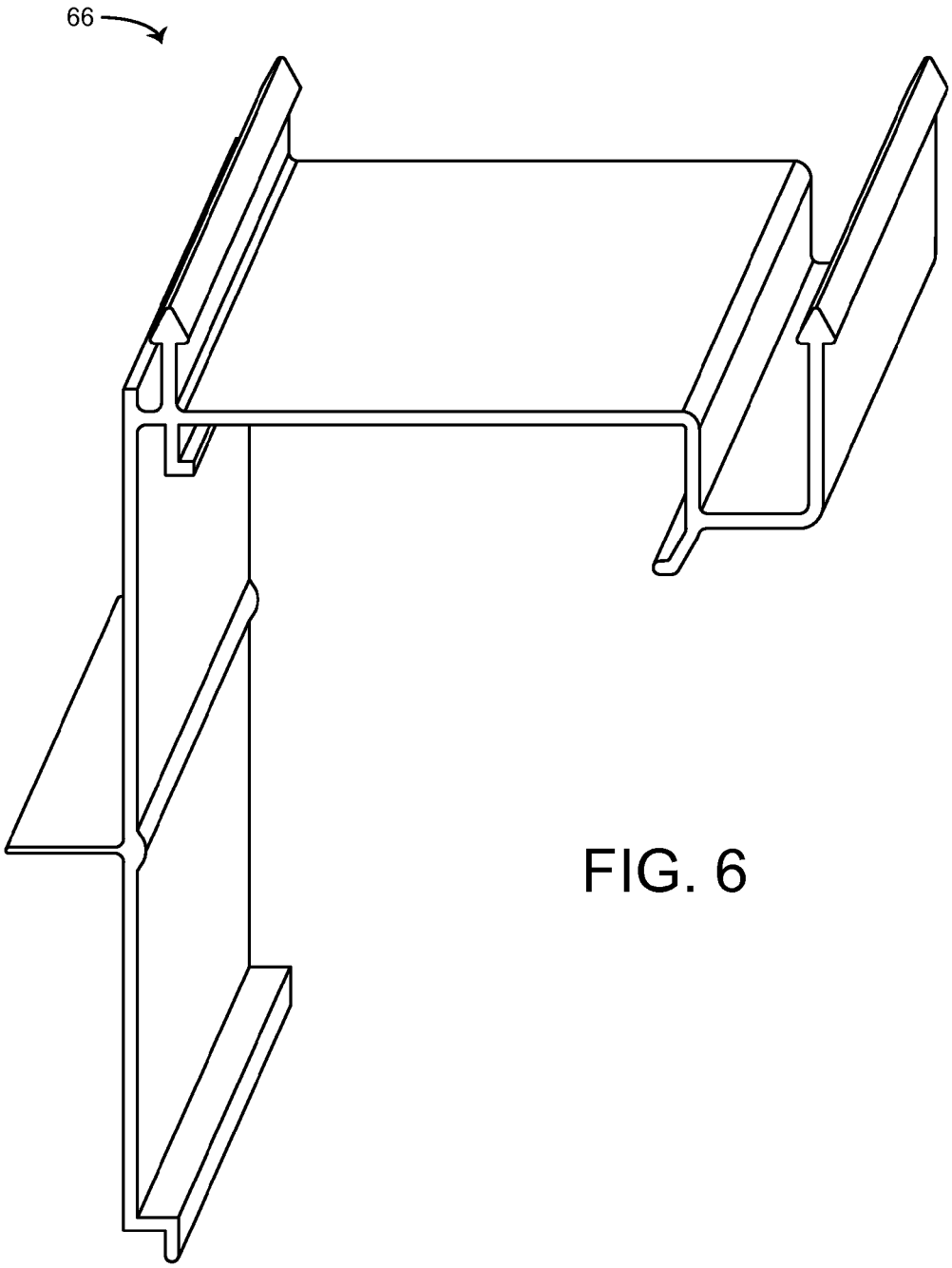
FIG. 6 is a perspective view illustrating the mounting bracket of FIG. 4 in greater detail, according to an exemplary embodiment.
Figure 7:
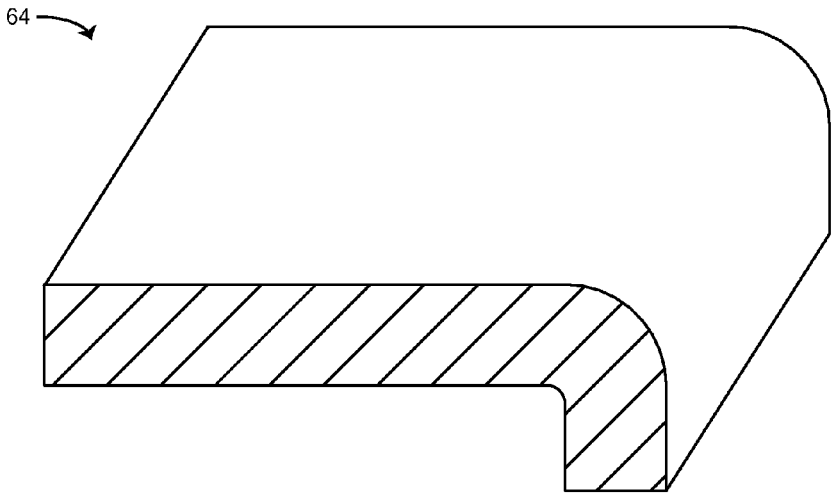
FIG. 7 is a perspective view illustrating the vacuum panel of FIG. 4 in greater detail, according to an exemplary embodiment.
Figure 8:
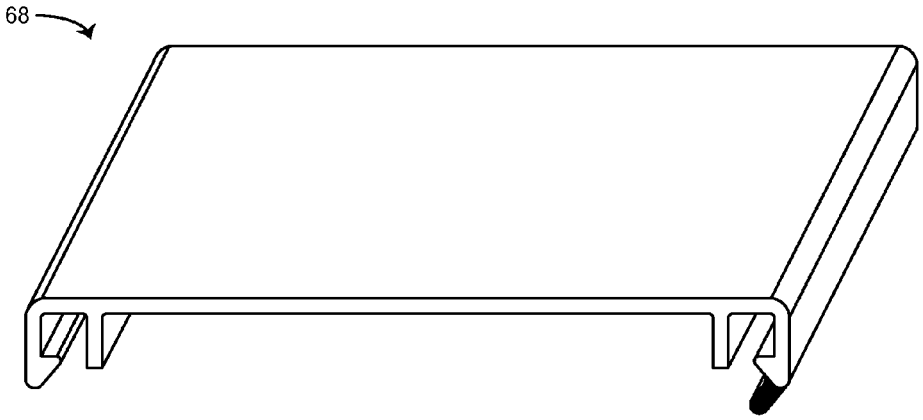
FIG. 8 is a perspective view illustrating the cover of FIG. 4 in greater detail, according to an exemplary embodiment.

Referring now to FIGS. 4-8, a perimeter frame segment assembly 60 and components thereof are shown, according to an exemplary embodiment. Assembly 60 is shown to include a perimeter frame segment 62 (i.e., one of frame segments 26-32), mounting bracket 66, vacuum panel 64, and cover 68. FIG. 4 is a cross-sectional view of assembly 60 and FIGS. 5-8 are perspective views illustrating segments of components 62-68. Although only short segments of components 62-68 are shown in FIGS. 5-8, it is understood that components 62-68 may have any length in various embodiments. For example, assembly 60 may extend vertically between top frame segment 26 and bottom frame segment 28. In some embodiments, perimeter frame segment 62 is made from a metallic material (e.g., aluminum, steel, etc.). Mounting bracket 66 may be made from a rigid or substantially rigid insulator such as PVC or another polymer and may be configured to provide thermal insulation between perimeter frame segment 62 and body portion 12.

Perimeter frame segment 62 is shown to include a plurality of connected walls 81-86 that define the general shape of perimeter frame segment 62. Wall 81 may extend along frontal portion 22 of refrigerated enclosure 10 (as shown in FIG. 3) and may be visible from the front of refrigerated enclosure 10 when doors 36 are closed (as shown in FIGS. 1-2). Wall 82 may extend rearwardly from frontal portion 22 (i.e., toward rear wall 46) through the opening in body portion 12 and may be connected to wall 81 along an inner edge 124 of wall 81. Inner edge 124 may be the edge of wall 81 that is closest to the opening in body portion 12.

Wall 84 may extend in a second direction (i.e., other than rearwardly, to the right in FIG. 4) from a rearward edge 126 of wall 82. In some embodiments, wall 84 is oriented substantially perpendicular to wall 82 and may extend toward the opposite frame segment of thermal frame 24. For example, if perimeter frame segment 62 is the left side frame segment 30, wall 84 may extend toward right side frame segment 32. If perimeter frame segment 62 is bottom frame segment 28, wall 84 may extend toward top frame segment 26. Wall 84 is shown to include a first end 128 proximate to wall 82 and a second end 130 opposite first end 128.

Wall 86 may extend from wall 84 toward frontal portion 22 of refrigerated enclosure 10. In some embodiments, wall 86 is oriented substantially perpendicular to wall 84. Wall 86 may extend from second end 130 of wall 84 to define a channel 88 between walls 82, 84, and 86. In some embodiments, channel 88 is a "C-shaped" or "U-shaped" channel with an open front. Contact plate 44*a* may extend between walls 82 and 86, thereby closing channel 88. Contact plate 44*a* may be held in place with a retaining clip 132 (e.g., a zipper strip or other suitable fastening device). Retaining clip 132 may be coupled to wall 86 via an engagement feature 134 (e.g., a flange, a notch, a lip, a collar, a groove, etc.) of wall 86.

In some embodiments, perimeter frame segment 62 includes a support 87 within channel 88. Support 87 may be configured to secure a heater wire 89 within channel 88 and to ensure that heater wire 89 maintains contact with contact plate 44*a*.

Still referring to FIGS. 4-8, mounting bracket 66 may be configured to secure perimeter frame segment 62 to the perimeter of the opening in body portion 12 and to support vacuum panel 64. Mounting bracket 66 may be attached to perimeter frame segment 62 via one or more engagement features (e.g., flange 125, collar 127, flange 129, grooves, notches, etc.) and/or fasteners and may be fixed to an inner perimeter of the opening in body portion 12.

Mounting bracket 66 is shown to include a plurality of walls 92-102 that define the general shape of mounting bracket 66. Wall 92 may be disposed between wall 82 of perimeter frame segment 62 and the perimeter of the opening in body portion 12. Wall 92 may extend rearwardly from frontal portion 22 through the opening in body portion 12.

Wall 94 may be disposed rearward of wall 84 (e.g., between wall 84 and vacuum panel 64) and may extend in the second direction (e.g., to the right in FIG. 4) from a rearward edge 136 of wall 92. In some embodiments, wall 94 is oriented substantially perpendicular to wall 92 and may extend toward the opposite frame segment of thermal frame 24. Wall 94 is shown to include a first end 138 proximate wall 92 and a second end 140 opposite first end 138.

Wall 96 may extend from wall 94 toward frontal portion 22 of refrigerated enclosure 10. In some embodiments, wall 96 is oriented substantially perpendicular to wall 94. Wall 96 may extend from second end 140 of wall 84 to define a front channel 104 between walls 92, 94, and 96. In some embodiments, front channel 104 is a "C-shaped" or "U-shaped" channel with an open front. Perimeter frame segment 62 may be located at least partially within front channel 104.

In some embodiments, mounting bracket 66 includes a wall 98 extending rearwardly from first end 138 of wall 94. Mounting bracket 66 may include a wall 102 offset from wall 98 in the second direction (e.g., to the right in FIG. 4) and coupled to second end 140 of wall 94. Wall 102 may be coupled to wall 94 directly (e.g., extending from wall 94) or indirectly (e.g., via one or more intermediate walls 96 and 100, as shown in FIG. 4). Walls 94, 98, and 102 may at least partially define a rear channel 106 within which vacuum panel 64 is contained. Wall 100 may extend between walls 96 and 102 to define a portion of rear channel 106 between walls 96, 100, and 102. In some embodiments, rear channel 106 includes a bend such that rear channel 106 extends along multiple adjacent surfaces of perimeter frame segment 62 (e.g., along walls 84 and 86).

Cover 68 may extend between walls 98 and 102 to close rear channel 106 and secure vacuum panel 64 therein. In some embodiments, cover 68 includes engagement features 120 at each end of cover 68. Mounting bracket 66 may include corresponding engagement features 122 along rearward ends of walls 98 and 106. Features 120 may be configured to engage features 122 to secure cover 68 to mounting bracket 66 and hold vacuum panel 64 within rear channel 106. In some embodiments, cover 68 includes a seal 142 attached to an end thereof (e.g., extending from engagement feature 120). Seal 142 may be made of a flexible material such as flexible PVC, rubber, or another polymer. Seal 142 may be configured to provide a seal between cover 68 and mounting bracket 66 when cover 68 is secured to mounting bracket 66.

Still referring to FIGS. 4-8, vacuum panel 64 may positioned rearward of perimeter frame segment 62 and may be configured to reduce heat transfer through perimeter frame segment 62. Vacuum panel 64 may be located within rear channel 106 and may extend along multiple adjacent surfaces of perimeter frame segment 62 (e.g., along walls 84 and 86). Vacuum panel 64 may include a front surface 108, a rear surface 110, and an evacuated chamber 112 between surfaces 108 and 110. Rear surface 110 may be offset from front surface 108 by a thickness. In some embodiments, vacuum panel 64 has a thermal resistance between $$25\ \frac{\text{hr}\cdot\text{ft}^2\cdot{}^\circ\text{ F.}}{\text{BTU}}$$

and $$100\ \frac{\text{hr}\cdot\text{ft}^2\cdot{}^\circ\text{ F.}}{\text{BTU}}$$

per inch of the thickness of evacuated chamber 112.

In some embodiments, vacuum panel 64 includes at least one bend 118 and evacuated chamber 112 is a continuous chamber bridging bend 118. For example, vacuum panel 64 is shown to include a surface 114 extending from front surface 108 toward frontal portion 22 and a surface 116 extending from surface 110 toward frontal portion 22. Surface 116 may be offset from surface 114 by the thickness of evacuated chamber 112 in the second direction (e.g., to the right in FIG. 4). Evacuated chamber 112 may extend between surfaces 114 and 116 such that evacuated chamber 112 extends through bend 118 and provides thermal insulation for both wall 84 and wall 86 of perimeter frame segment 62.

In some embodiments, perimeter frame segment assembly 60 includes a lighting element (e.g., an LED strip, a fluorescent tube, an incandescent bulb, etc.) attached to one or more of components 62-68 and configured to illuminate the interior of refrigerated enclosure 10. The lighting element may be disposed along a rear surface of cover 68 and configured to emit light toward items within temperature-controlled space 48. In some embodiments, assembly 60 includes a mounting plate positioned between cover 68 and vacuum panel 64. The mounting plate may include one or more studs that extend through cover 68 and attach to the lighting element rearward of cover 68. Advantageously, the mounting plate may allow the lighting element to be attached to assembly 60 without puncturing vacuum panel 64. In other embodiments, the lighting element may be secured to assembly 60 via a channel system along the rear surface of cover 68, via one or more fasteners (e.g., snap fittings, structural adhesive tape, bolts, screws, etc.), or any other means for attaching the lighting element to assembly 60. In some embodiments, assembly 60 includes a wireway (e.g., a channel, a path, a guide, etc.) configured to route a power wire and/or signal wire from the lighting element to assembly 60. The wireway may be attached to a top of bottom of assembly 60 to cover a wiring connection between the lighting element and assembly 60.

Figure 9:
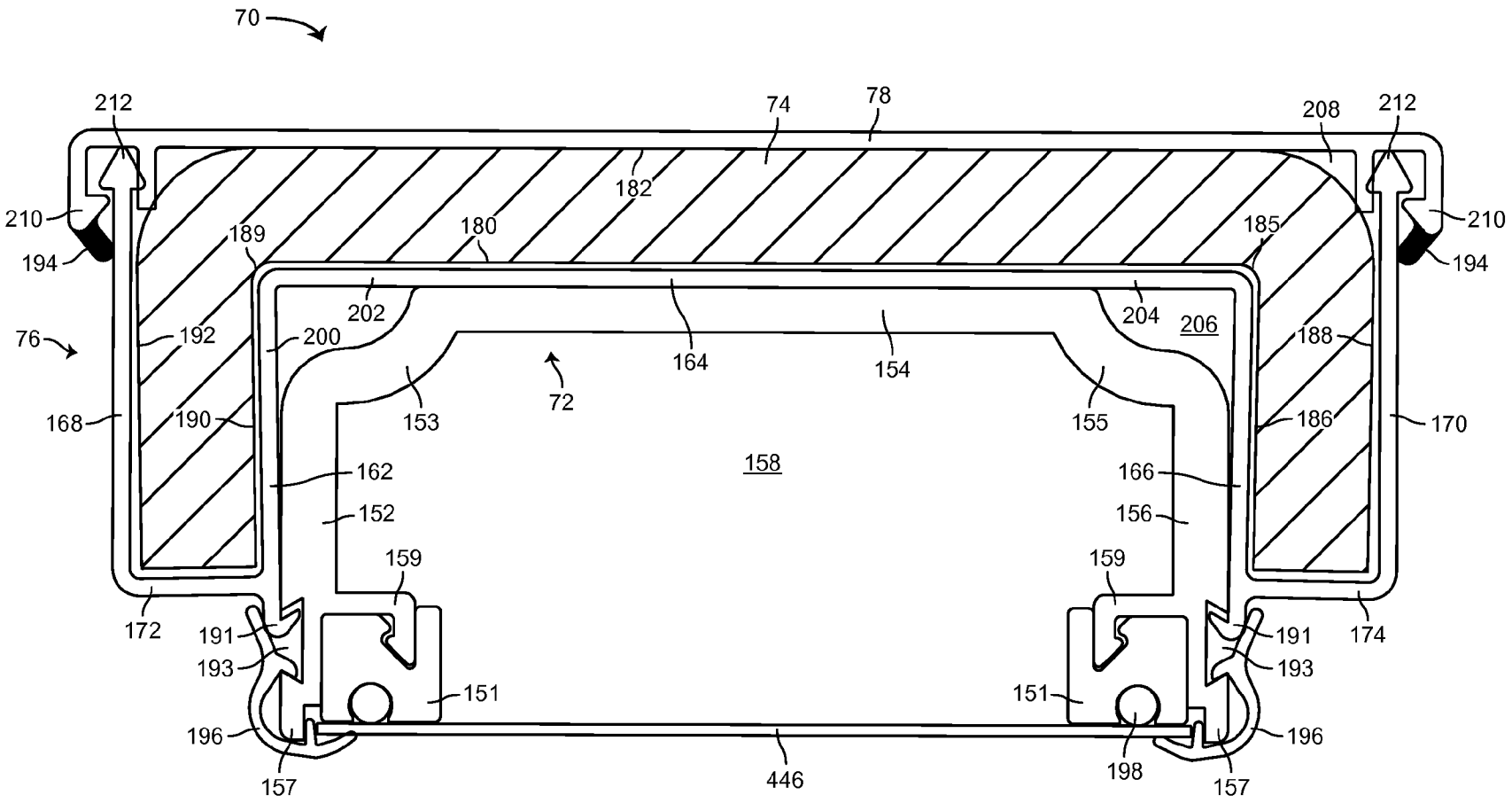
FIG. 9 is a cross-sectional view illustrating the mullion frame assembly of FIG. 3 in greater detail and showing a mullion frame segment, a mounting bracket, a vacuum panel, and a cover, according to an exemplary embodiment.
Figure 10:
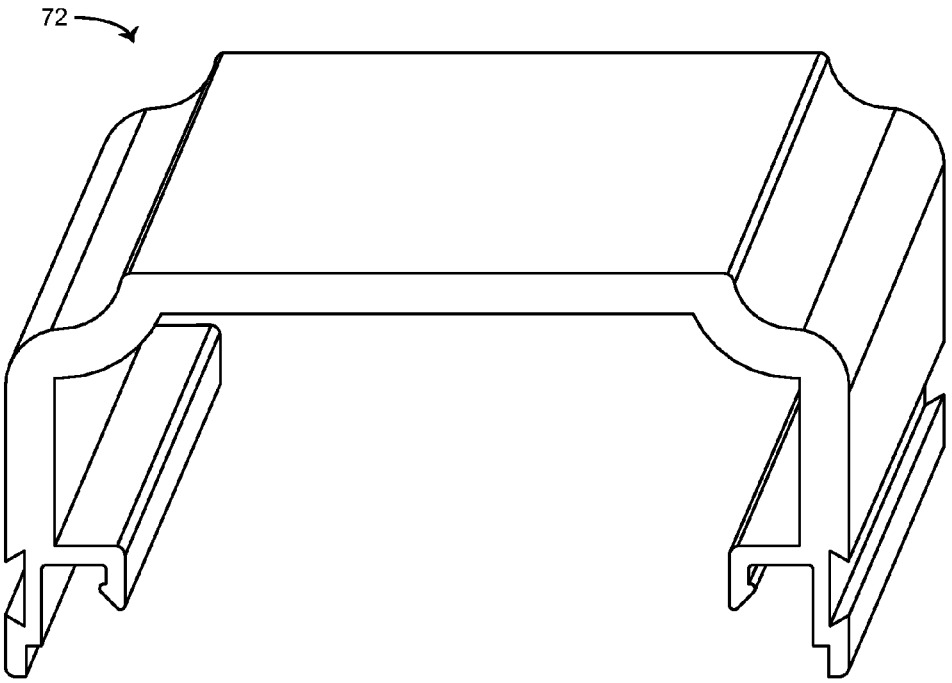
FIG. 10 is a perspective view illustrating the mullion frame segment of FIG. 9 in greater detail, according to an exemplary embodiment.
Figure 11:
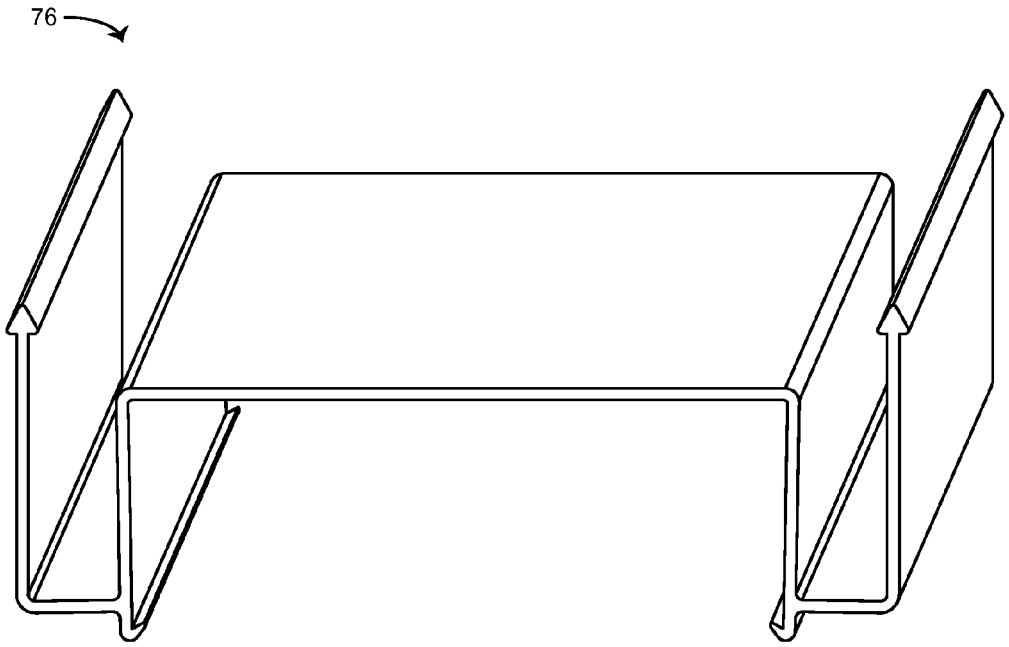
FIG. 11 is a perspective view illustrating the mounting bracket of FIG. 9 in greater detail, according to an exemplary embodiment.
Figure 12:
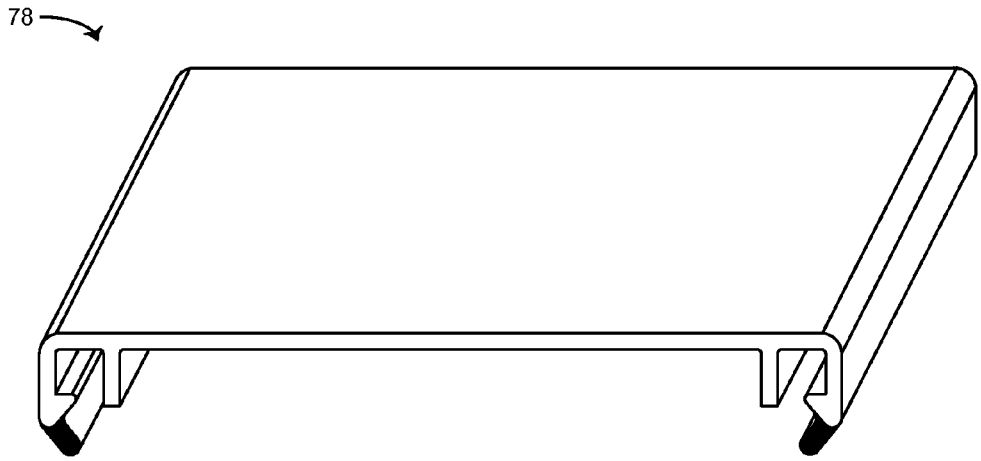
FIG. 12 is a perspective view illustrating the cover of FIG. 9 in greater detail, according to an exemplary embodiment.
Figure 13:
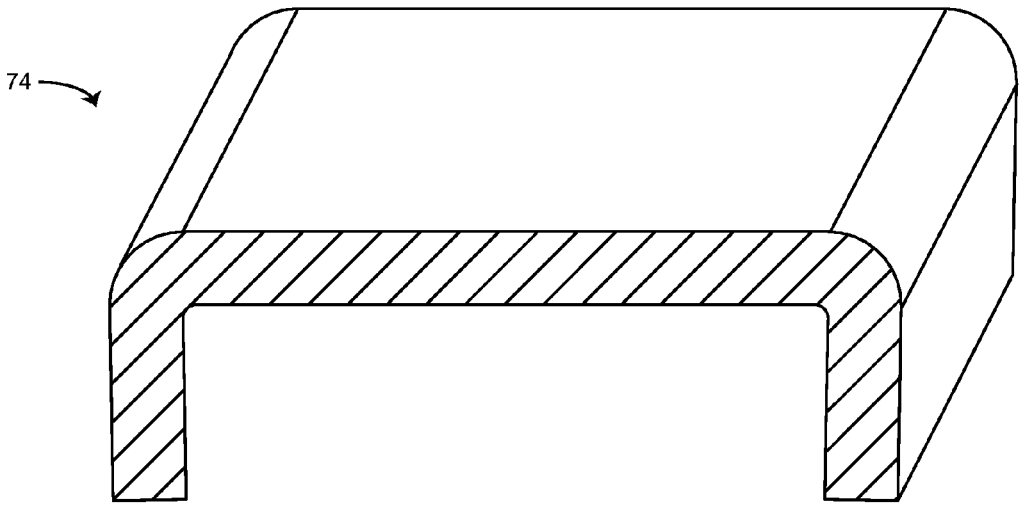
FIG. 13 is a perspective view illustrating the vacuum panel of FIG. 9 in greater detail, according to an exemplary embodiment.

Referring now to FIGS. 9-13, a mullion frame segment assembly 70 and components thereof are shown, according to an exemplary embodiment. Assembly 70 is shown to include a mullion frame segment 72 (i.e., one of mullion frame segments 34), mounting bracket 76, vacuum panel 74, and cover 78. FIG. 9 is a cross-sectional view of assembly 70 and FIGS. 10-13 are perspective views illustrating segments of components 72-78. Although only short segments of components 72-78 are shown in FIGS. 10-13, it is understood that components 72-78 may have any length in various embodiments. For example, assembly 70 may extend vertically between top frame segment 26 and bottom frame segment 28. In some embodiments, mullion frame segment 72 is made from a metallic material (e.g., aluminum, steel, etc.). Mounting bracket 76 may be made from a rigid or substantially rigid insulator such as PVC or another polymer and may be configured to provide thermal insulation between mullion frame segment 72 and the temperature-controlled space 48.

Mullion frame segment 72 is shown to include a plurality of connected walls 152-156 that define the general shape of mullion frame segment 72. In some embodiments, mullion frame segment 72 is offset rearward of frontal portion 22 such that contact plate **44*b* is substantially aligned with contact plate 44*a* (as shown in FIG. 3). Wall 152 may extend rearwardly from contact plate 44*b*, toward rear wall 46 of refrigerated enclosure 10. Wall 154 may extend in a second direction (i.e., other than rearwardly, to the right in FIG. 9) from a rearward edge of wall 152. In some embodiments, wall 154 is oriented substantially perpendicular to wall 152. Wall 156 may extend from wall 154 toward frontal portion 22 of refrigerated enclosure 10 and may be oriented substantially perpendicular to wall 154**.

Wall 156 may extend from an end of wall 154 opposite wall 152 to define a channel 158 between walls 152, 154, and 156. In some embodiments, channel 158 is a "C-shaped" or "U-shaped" channel with an open front. Contact plate **44*b* may extend between walls 152 and 156, thereby closing channel 158. Contact plate 44*b* may be held in place by one or more retaining clips 196 (e.g., zipper strips or other suitable fastening devices). Retaining clips 196 may be coupled to walls 152 and/or 156 via an engagement feature 157 (e.g., a flange, a notch, a lip, a collar, a groove, etc.) of walls 152 and/or walls 156**.

In some embodiments, mullion frame segment 72 includes a first inverted fillet 153 at the intersection of walls 152 and 154, and a second inverted fillet 155 at the intersection of walls 154 and 156. Inverted fillets 153 and 155 may include a convex surface along an interior of channel 158 and a concave surface along an exterior of channel 158. In some embodiments, mullion frame segment 72 includes supports 151 within channel 158. Supports 151 may be configured to secure a heater wire 198 within channel 158 and to ensure that heater wire 198 maintains contact with contact plate **44*b***.

Still referring to FIGS. 9-13, mounting bracket 76 may be configured to attach vacuum panel 74 to mullion frame segment 72. Mounting bracket 76 may be attached to mullion frame segment 72 via one or more engagement features (e.g., flanges 191, grooves 193, etc.) and/or fasteners. Mounting bracket 76 is shown to include a plurality of walls 162-174 that define the general shape of mounting bracket 76. Wall 162 may be disposed between wall 152 of mullion frame segment 72 and a portion of vacuum panel 74. Wall 162 may extend rearwardly relative to frontal portion 22 and may be substantially aligned with wall 152.

Wall 164 may be disposed rearward of wall 154 (e.g., between wall 154 and vacuum panel 74) and may extend in the second direction (e.g., to the right in FIG. 9) from a rearward edge 200 of wall 162. In some embodiments, wall 164 is oriented substantially perpendicular to wall 162. Wall 164 is shown to include a first end 202 proximate wall 162 and a second end 204 opposite first end 202.

Wall 166 may extend from wall 164 toward frontal portion 22 of refrigerated enclosure 10. In some embodiments, wall 166 is oriented substantially perpendicular to wall 164. Wall 166 may extend from second end 204 of wall 184 to define a front channel 206 between walls 162, 164, and 166. In some embodiments, front channel 206 is a "C-shaped" or "U-shaped" channel with an open front. Mullion frame segment 72 may be located at least partially within front channel 206.

In some embodiments, mounting bracket 76 includes a wall 168 coupled to first end 202 of wall 164 and extending rearward of wall 164. Wall 168 may be coupled to wall 164 directly (e.g., extending rearward from wall 164) or via one or more intermediate walls (e.g., walls 162 and 172, as shown in FIG. 9). Mounting bracket 76 may include a wall 170 coupled to second end 204 of wall 164 and extending rearward of wall 164. Wall 170 may be coupled to wall 164 directly (e.g., extending rearward from wall 164) or via one or more intermediate walls (e.g., walls 166 and 174, as shown in FIG. 9). Walls 164, 168, and 170 may at least partially define a rear channel 208 within which vacuum panel 74 is contained.

In some embodiments, wall 170 is offset from wall 166 in the second direction (e.g., to the right in FIG. 9). Mounting bracket 76 may include a wall 174 extending between wall 166 and wall 170 to define a portion of rear channel 208 between wall 166, wall 170, and wall 174. In some embodiments, wall 168 is offset from wall 162 in a third direction opposite the second direction (e.g., to the left in FIG. 9). Mounting bracket 76 may include a wall 172 extending between wall 162 and wall 168 to define a portion of rear channel 208 between wall 162, wall 168, and wall 172. In some embodiments, rear channel 208 includes one or more bends such that rear channel 208 extends along multiple adjacent surfaces of mullion frame segment 72 (e.g., along wall 152, wall 154, and/or wall 156).

Cover 78 may extend between walls 168 and 170 to close rear channel 208 and secure vacuum panel 74 therein. In some embodiments, cover 78 includes engagement features 210 at each end of cover 78. Mounting bracket 76 may include corresponding engagement features 212 along rearward ends of walls 168 and 170. Features 210 may be configured to engage features 212 to secure cover 78 to mounting bracket 76 and hold vacuum panel 74 within rear channel 208. In some embodiments, cover 78 includes one or more seals 194 attached to ends thereof (e.g., extending from engagement features 210). Seals 194 may be made of a flexible material such as flexible PVC, rubber, or another polymer. Seals 194 may be configured to provide a seal between cover 78 and mounting bracket 76 when cover 78 is secured to mounting bracket 76.

Still referring to FIGS. 9-13, vacuum panel 64 may positioned rearward of mullion frame segment 72 and may be configured to reduce heat transfer through mullion frame segment 72. Vacuum panel 74 may be located within rear channel 208 and may extend along multiple adjacent surfaces of mullion frame segment 72 (e.g., along walls 152, 154, and/or 156). Vacuum panel 74 may include a front surface 180, a rear surface 182, and an evacuated chamber 184 between surfaces 180 and 182. Rear surface 182 may be offset from front surface 180 by a thickness. In some embodiments, vacuum panel 74 has a thermal resistance between $$25\ \frac{\text{hr}\cdot\text{ft}^2\cdot{}^\circ\text{ F.}}{\text{BTU}}$$

and $$100\ \frac{\text{hr}\cdot\text{ft}^2\cdot{}^\circ\text{ F.}}{\text{BTU}}$$

per inch of the thickness of evacuated chamber 184.

In some embodiments, vacuum panel 64 includes one or more bends (e.g., bends 185 and/or 189) and evacuated chamber 184 is a continuous chamber bridging the one or more bends. For example, vacuum panel 74 is shown to include a surface 186 extending from front surface 180 toward frontal portion 22, and a surface 188 extending from surface 182 toward frontal portion 22. Surface 188 may be offset from surface 186 by the thickness of evacuated chamber 184 in the second direction (e.g., to the right in FIG. 9). Evacuated chamber 184 may extend between surfaces 186 and 188 such that evacuated chamber 184 extends through bend 185 and provides thermal insulation for both wall 154 and wall 156 of mullion frame segment 72. Vacuum panel 74 may also include a surface 190 extending from front surface 180 toward frontal portion 22, and a surface 192 extending from surface 182 toward frontal portion 22. Surface 192 may be offset from surface 190 by the thickness of evacuated chamber 184 in a third direction opposite the second direction (e.g., to the left in FIG. 9). Evacuated chamber 184 may extend between surfaces 190 and 192 such that evacuated chamber 184 extends through bend 189 and provides thermal insulation for both wall 152 and wall 154 of mullion frame segment 72.

In some embodiments, mullion frame segment assembly 70 includes a lighting element (e.g., an LED strip, a fluorescent tube, an incandescent bulb, etc.) attached to one or more of components 72-78 and configured to illuminate the interior of refrigerated enclosure 10. The lighting element may be disposed along a rear surface of cover 78 and configured to emit light toward items within temperature-controlled space 48. In some embodiments, assembly 70 includes a mounting plate positioned between cover 78 and vacuum panel 74. The mounting plate may include one or more studs that extend through cover 78 and attach to the lighting element rearward of cover 78. Advantageously, the mounting plate may allow the lighting element to be attached to assembly 70 without puncturing vacuum panel 74. In other embodiments, the lighting element may be secured to assembly 70 via a channel system along the rear surface of cover 78, via one or more fasteners (e.g., snap fittings, structural adhesive tape, bolts, screws, etc.), or any other means for attaching the lighting element to assembly 70. In some embodiments, assembly 70 includes a wireway (e.g., a channel, a path, a guide, etc.) configured to route a power wire and/or signal wire from the lighting element to assembly 70. The wireway may be attached to a top of bottom of assembly 70 to cover a wiring connection between the lighting element and assembly 70.

In any embodiment, thermal frame 24 may include a perimeter frame 62 segment fixed to refrigerated enclosure 10 along a perimeter of the opening and/or a mullion frame 72 segment fixed to refrigerated enclosure 10 and dividing the opening into a plurality of smaller openings. Thermal frame 24 may include a first vacuum panel 64 fixed relative to perimeter frame segment 62 and configured to reduce heat transfer through perimeter frame segment 62 and/or a second vacuum panel 74 fixed relative to mullion frame segment 72 and configured to reduce heat transfer through mullion frame segment 72. In some embodiments, each vacuum panel is located at least partially rearward of the frame segment to which the vacuum panel is attached.

Any of the vacuum panels may include a plurality of interconnected sub-panels oriented in multiple different directions and connected by one or more bends (e.g., bends 118, 185, and/or 189) located at an edge between the plurality of sub-panels. Each vacuum panel may include an evacuated chamber (e.g., chamber 112 and/or 184) bridging the bends and extending continuously within the plurality of sub-panels. Advantageously, the vacuum panels may extend along multiple adjacent surfaces of the corresponding frame segments for improved thermal insulation.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," "attached," "secured" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the refrigerated case with thermal door frame as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A thermal frame for an opening in a refrigerated enclosure, the thermal frame comprising:

a perimeter frame segment configured to be fixed to a refrigerated enclosure along a perimeter of an opening of the refrigerated enclosure, the perimeter frame segment comprising:

a first wall configured to extend rearwardly from a frontal portion of the refrigerated enclosure, a second wall extending in a second direction from a rearward edge of the first wall, and a third wall configured to extend from the second wall toward the frontal portion of the refrigerated enclosure to define a first channel between the first, second, and third walls;

a vacuum panel fixed relative to the perimeter frame segment and comprising:

a first surface disposed rearward of the second wall, a second surface disposed rearward of the first surface and offset from the first surface by a thickness, and an evacuated chamber between the first and second surfaces; and a mounting bracket configured to secure the perimeter frame segment to the perimeter of the opening and to support the vacuum panel, the mounting bracket comprising:

a fifth wall disposed between the second wall of the perimeter frame segment and the first surface of the vacuum panel, a seventh wall coupled to a first end of the fifth wall and extending rearward of the fifth wall, an eighth wall coupled to a second end of the fifth wall opposite the first end, and extending rearward of the fifth wall, wherein the fifth, seventh, and eighth walls at least partially define a third channel within which the vacuum panel is contained, a sixth wall configured to extend from the second end of the fifth wall toward the frontal portion of the refrigerated enclosure, wherein the eighth wall is offset from the sixth wall in the second direction, and a ninth wall extending between the sixth wall and the eighth wall to define a portion of the third channel between the sixth, eighth, and ninth walls.

2. The thermal frame of claim 1, wherein the vacuum panel is configured to reduce heat transfer through the perimeter frame segment.

3. The thermal frame of claim 1, wherein the vacuum panel has a thermal resistance between $$25\ \frac{\text{hr}\cdot\text{ft}^2\cdot{}^\circ\text{ F.}}{\text{BTU}}$$

per inch of the thickness and $$\frac{\text{hr}\cdot\text{ft}^2\cdot{}^\circ\text{ F.}}{\text{BTU}}$$

100 per inch of the thickness.

4. The thermal frame of claim 1, wherein the vacuum panel comprises at least one bend and the evacuated chamber is a continuous chamber bridging the bend.

5. The thermal frame of claim 1, wherein the vacuum panel further comprises:

a third surface configured to extend from the first surface toward the frontal portion of the refrigerated enclosure; and a fourth surface configured to extend from the second surface toward the frontal portion of the refrigerated enclosure and offset from the third surface by the thickness in the second direction;

wherein the evacuated chamber extends between the third and fourth surfaces.

6. The thermal frame of claim 1, wherein the mounting bracket comprises:

a fourth wall configured to be disposed between the first wall of the perimeter frame segment and the perimeter of the opening;

the fifth wall disposed between the second wall of the perimeter frame segment and the first surface of the vacuum panel and extending in the second direction from a rearward edge of the fourth wall; and the sixth wall configured to extend from the fifth wall toward the frontal portion of the refrigerated enclosure to define a second channel between the fourth, fifth, and sixth walls;

wherein the perimeter frame segment is located at least partially within the second channel.

7. The thermal frame of claim 1, further comprising a cover extending between the seventh and eighth walls and closing the third channel.

8. The thermal frame of claim 7, wherein the cover comprises:

a first engagement feature located along a first edge of the cover and configured to engage a corresponding engagement feature of the seventh wall; and a second engagement feature located along a second edge of the cover and configured to engage a corresponding engagement feature of the eighth wall.

9. The thermal frame of claim 1, further comprising a contact plate extending between the first and third walls and closing the first channel.

10. A thermal frame for an opening in a refrigerated enclosure, the thermal frame comprising:

a mullion frame segment configured to be fixed to a refrigerated enclosure and configured to divide an opening of the refrigerated enclosure into a plurality of smaller openings, the mullion frame segment comprising:

a first wall configured to extend rearwardly relative to a frontal portion of the refrigerated enclosure, a second wall extending in a second direction from a rearward edge of the first wall, and a third wall configured to extend from the second wall toward the frontal portion of the refrigerated enclosure to define a first channel between the first, second, and third walls;

a vacuum panel fixed relative to the mullion frame segment and comprising:

a first surface disposed rearward of the second wall, a second surface disposed rearward of the first surface and offset from the first surface by a thickness, and an evacuated chamber between the first and second surfaces;

a mounting bracket configured to secure the vacuum panel to the mullion frame segment, the mounting bracket comprising:

a fifth wall disposed between the second wall of the mullion frame segment and the first surface of the vacuum panel, a seventh wall coupled to a first end of the fifth wall and extending rearward of the fifth wall, wherein the seventh wall is offset from the first wall in a third direction opposite the second direction, an eighth wall coupled to a second end of the fifth wall opposite the first end, and extending rearward of the fifth wall, wherein the fifth, seventh, and eighth walls at least partially define a third channel within which the vacuum panel is contained, a fourth wall configured to extend from the first end of the fifth wall toward the frontal portion of the refrigerated enclosure; and a ninth wall extending between the fourth wall and the seventh wall to define a portion of the third channel between the fourth, seventh, and ninth walls.

11. The thermal frame of claim 10, wherein the vacuum panel is configured to reduce heat transfer through the mullion frame segment.

12. The thermal frame of claim 10, wherein the vacuum panel has a thermal resistance between $$25\ \frac{\text{hr}\cdot\text{ft}^2\cdot{}^\circ\text{ F.}}{\text{BTU}}$$

per inch of the thickness and $$\frac{\text{hr}\cdot\text{ft}^2\cdot{}^\circ\text{ F.}}{\text{BTU}}$$

100 per inch of the thickness.

13. The thermal frame of claim 10, wherein the vacuum panel comprises at least one bend and the evacuated chamber is a continuous chamber bridging the bend.

14. The thermal frame of claim 10, wherein the vacuum panel further comprises:

a third surface configured to extend from a first edge of the first surface toward the frontal portion of the refrigerated enclosure; and a fourth surface configured to extend from a first edge of the second surface toward the frontal portion of the refrigerated enclosure and offset from the third surface by the thickness in the second direction;

wherein the evacuated chamber extends between the third and fourth surfaces.

15. The thermal frame of claim 14, wherein the vacuum panel further comprises:

a fifth surface configured to extend from a second edge of the first surface and toward the frontal portion of the refrigerated enclosure; and a sixth surface configured to extend from a second edge of the second surface toward the frontal portion of the refrigerated enclosure and offset from the fifth surface by the thickness in the third direction opposite the second direction;

wherein the evacuated chamber extends between the fifth and sixth surfaces.

16. The thermal frame of claim 10, wherein the mullion frame segment comprises an inverted fillet connecting the second wall with at least one of the first wall and the third wall, the inverted fillet comprising a convex surface along an interior of the first channel and a concave surface along an exterior of the first channel.

17. The thermal frame of claim 10, wherein the mounting bracket comprises:

a fourth wall extending rearwardly along an exterior surface of the first wall;

the fifth wall disposed between the second wall of the mullion frame segment and the first surface of the vacuum panel and extending in the second direction from a rearward edge of the fourth wall; and a sixth wall configured to extend from the fifth wall toward the frontal portion of the refrigerated enclosure to define a second channel between the fourth, fifth, and sixth walls;

wherein the mullion frame segment is located at least partially within the second channel.

18. The thermal frame of claim 10, further comprising a cover extending between the seventh and eighth walls and closing the third channel.

19. The thermal frame of claim 18, wherein the cover comprises:

a first engagement feature located along a first edge of the cover and configured to engage a corresponding engagement feature of the seventh wall; and a second engagement feature located along a second edge of the cover and configured to engage a corresponding engagement feature of the eighth wall.

20. A thermal frame for an opening in a refrigerated enclosure, the thermal frame comprising:

a mullion frame segment configured to be fixed to a refrigerated enclosure and configured to divide an opening of the refrigerated enclosure into a plurality of smaller openings, the mullion frame segment comprising:

a first wall configured to extend rearwardly relative to a frontal portion of the refrigerated enclosure, a second wall extending in a second direction from a rearward edge of the first wall, and a third wall configured to extend from the second wall toward the frontal portion of the refrigerated enclosure to define a first channel between the first, second, and third walls;

a vacuum panel fixed relative to the mullion frame segment and comprising:

a first surface disposed rearward of the second wall, a second surface disposed rearward of the first surface and offset from the first surface by a thickness, and an evacuated chamber between the first and second surfaces;

a mounting bracket configured to secure the vacuum panel to the mullion frame segment, the mounting bracket comprising:

a fifth wall disposed between the second wall of the mullion frame segment and the first surface of the vacuum panel, a seventh wall coupled to a first end of the fifth wall and extending rearward of the fifth wall, an eighth wall coupled to a second end of the fifth wall, opposite the first end, and extending rearward of the fifth wall, wherein the eighth wall is offset from the third wall in the second direction, wherein the fifth, seventh, and eighth walls at least partially define a third channel within which the vacuum panel is contained, a sixth wall configured to extend from the second end of the fifth wall toward the frontal portion of the refrigerated enclosure; and a tenth wall extending between the sixth wall and the eighth wall to define a portion of the third channel between the sixth, eighth, and tenth walls.

* * * * *